US006171131B1

(12) United States Patent
Lee

(10) Patent No.: US 6,171,131 B1
(45) Date of Patent: Jan. 9, 2001

(54) ELECTRICAL CONNECTOR ASSEMBLY

(75) Inventor: George Lee, Taipei (TW)

(73) Assignee: Hon Hai Precision Inc. Co., Ltd., Taipei Hsien (TW)

( * ) Notice: Under 35 U.S.C. 154(b), the term of this patent shall be extended for 0 days.

(21) Appl. No.: 09/394,338

(22) Filed: Sep. 13, 1999

(30) Foreign Application Priority Data

Jun. 7, 1999 (TW) ..... 88210077

(51) Int. Cl.[7] ..... H01R 13/627
(52) U.S. Cl. ..... 439/358; 439/405
(58) Field of Search ..... 439/357, 358, 439/404, 405, 417, 435, 456, 459, 470

(56) References Cited

U.S. PATENT DOCUMENTS 4,006,957 * 2/1977 Narozny .
4,359,257 * 11/1982 Lopinski et al. .
4,621,885 * 11/1986 Szczesny et al. .
5,108,306 * 4/1992 Wellinsky ..... 439/404
5,664,961 * 9/1997 Tsuji et al. ..... 439/358
5,762,513 * 6/1998 Stine ..... 439/358

* cited by examiner

*Primary Examiner*—Gary F. Paumen
(74) *Attorney, Agent, or Firm*—Wei Te Chung

(57) ABSTRACT

An insulation displacement connector (IDC) assembly comprises a first connector mounted to an electronic element and a second connector matable with the first connector for terminating a flat flexible cable. The second connector comprises a second housing matable with a first housing of the first connector, a plurality of second terminals received in the second housing, a terminating cover attached to the second housing for pressing the flexible cable onto the second terminals, and a pressing member. The pressing member comprises a main body and a pair of latching arms perpendicularly extending from opposite ends of the main body for securing the second connector with the first connector. A curved connecting portion is formed between each latching arm and the main body for providing the latching arm with sufficient deformation space and proper resiliency. When an external force is exerted on a pressing portion of each latching arm, a latching hook of the latching arm simultaneously pivots outward about the curved connecting portion thereby releasing the second connector from the first connector.

1 Claim, 4 Drawing Sheets

ELECTRICAL CONNECTOR ASSEMBLY

BACKGROUND OF THE INVENTION

The present invention relates to an electrical connector assembly, and particularly to an insulation displacement connector (IDC) assembly having a retention mechanism for being securely fixed with an electronic element.

DESCRIPTION OF THE PRIOR ART

A conventional insulation displacement connector (IDC) commonly comprises a dielectric housing and a plurality of terminals received in the housing. Each terminal has a IDC termination section for piercing an insulation covering of a conductive wire which is terminated to the IDC termination section of the corresponding terminal. A cover is used to facilitate termination between the conductive wires and the piercing portion.

Pertinent conventional IDC connectors are disclosed in U.S. Pat. Nos. 4,006,957; 4,359,257 and 5,108,306. In order to ensure stable and reliable electrical connection between the terminals and the cable, a strain relief is commonly used to prevent disengagement of the electrical connections between terminals and the wire due to vibrations or other external forces. The strain relief is commonly assembled to a cover of the IDC. A flat cable terminated to the IDC termination sections is positioned between the cover and a housing of the IDC connector with an end being terminated to the IDC termination sections of the terminal projecting beyond a termination surface of the housing. The flat cable is then appropriately wound over and extends through a gap between the cover and the strain relief. The strain relief can thus disperse external force exerted on the flexible cable due to external vibration or other forces thereby preventing the IDC termination sections of the terminals and the conductors from disengagement.

However, interconnection between the strain relief and the cover of such an IDC connector may be adversely affected due to a large amount of build-up stress exerted on the flat cable, the strain relief or the cover. The build-up stress may be sufficient to drive the strain relief to disengage from the cover. Thus, electrical connections between conductors of the flat cable and corresponding terminals of the IDC connector are apt to be disrupted due to external force improperly exerted on the flat cable since the flat cable is terminated to a large quantity of terminals by insulation displacement.

Another conventional IDC connector is disclosed in U.S. Pat. No. 4,621,885. A retention member is provided for fixing the IDC connector with another connector mounted on a circuit board. However, the retention member is separately manufactured and performs only a retention function thereby complicating the manufacturing process of the IDC connector and increasing costs.

Referring further to U.S. Pat. No. 5,762,513, an IDC assembly comprises a header, a housing matable with the header, a termination cover retained on the housing, and a wiring strain relief securable as a unit to the header. Latches are integrally formed on the strain relief and each includes a pair of latch arms on opposite ends of the strain relief extending over the termination cover for latching the housing and the cover to the header. Each latch arm is connected with the strain relief via a hinge whereby the latch arm can pivot about the hinge. When an external pressing force is exerted on an upper portion of each latch arm, the latch arm is driven to outwardly pivot about the hinge thereby disengaging the strain relief, the cover and the housing from the header.

However, the hinge should be made very thin in order to exhibit proper resiliency for allowing the latch arm to pivot thereabout. Thus, when the latch arm is operated to pivot about the hinge, the hinge may sustain a large inner stress possibly leading to breakage thereof.

Therefore, an IDC connector having an improved retention mechanism is required.

BRIEF SUMMARY OF THE INVENTION

A main object of the present invention is to provide an insulation displacement connector (IDC) assembly which can ensure reliable signal transmission between a flat cable and a circuit board.

Another object of the present invention is to provide an IDC assembly which can be manufactured at a low cost.

An IDC assembly in accordance with the present invention comprises a first connector and a second connector matable with the first connector for terminating a flat flexible cable. The first connector is mounted on an electronic element, such as a circuit board, and comprises a first housing receiving a plurality of first terminals therein. The second connector comprises a second housing matable with the first housing of the first connector, a plurality of terminals received in the second housing, a terminating cover attached to the second housing for pressing the flexible cable onto the second terminals, and a pressing member. The pressing member is attached to the terminal cover for retaining the flexible cable in position and for preventing the cable from disengaging from the second terminals caused by additional external stress exerted on the cable due to vibrations or other forces.

A pair of latching arms perpendicularly extends from opposite ends of a main body of the pressing member for securing the second connector with the first connector. A curved connecting portion is formed between each latching arm and the main body for providing the latching arm with proper resiliency. Each latching arm comprises a latching hook for engaging with the first housing and a pressing section for facilitating manual operation thereof. The latching hook and the pressing section of the latching arm are located on opposite sides of the curved connecting portion. When an external force is exerted on the pressing portion, the latching hook of the latching arm simultaneously pivots outward about the curved connecting portion thereby releasing the second connector from the first connector. The curved connecting portion is semi-circular or arcuate and comprises a curved body, a groove recessed in the curved body and a pair of bumps extending from opposite inner side walls of the curved body into the groove. The groove provides the curved portion and the latching arm with sufficient deformation space and proper resiliency. When the pressing section of the latching arm is pressed to inwardly pivot about the curved connecting portion, the bumps are driven to approach and abut against each other, thus, pivotal movement of the latching arm ceases and the latching hook simultaneously disengages from the first housing of the first connector.

Other objects, advantages and novel features of the invention will become more apparent from the following detailed description when taken in conjunction with the accompanying drawings.

DETAILED DESCRIPTION OF THE INVENTION

Figure 1:
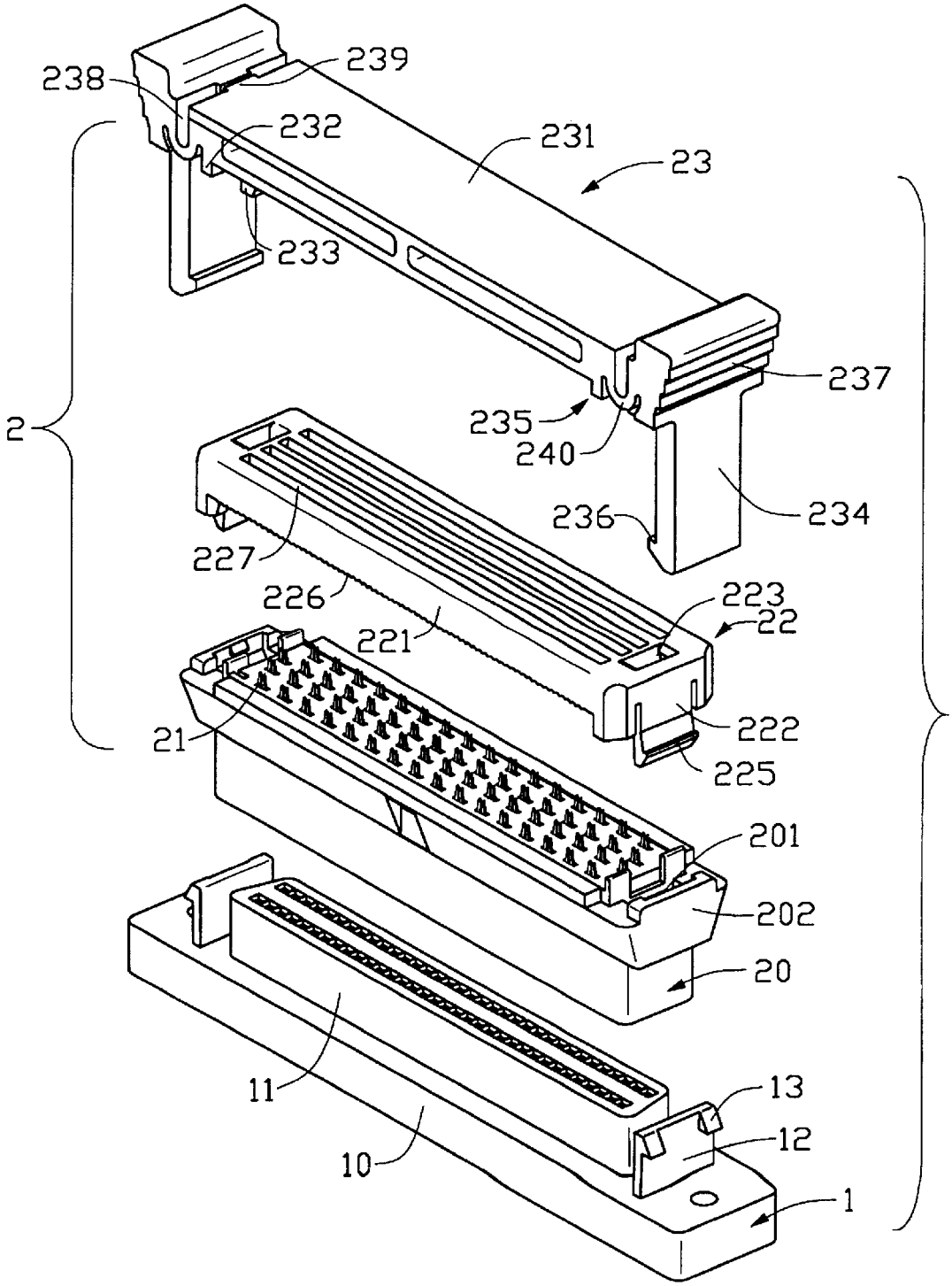
FIG. 1 is an exploded view of an insulation displacement connector (IDC) of the present invention.
Figure 2:
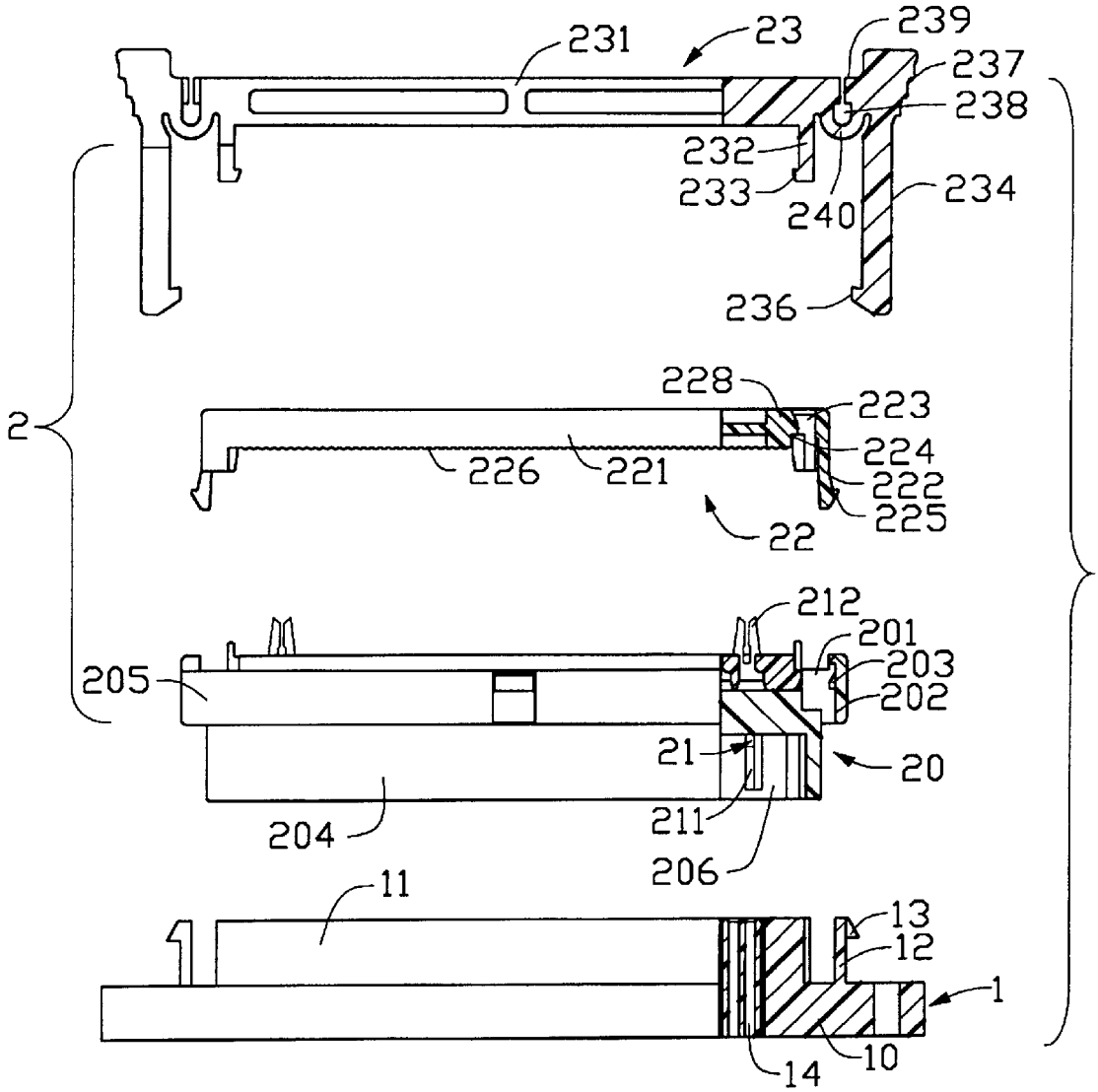
FIG. 2 is a planar and partial cross-sectional view of FIG. 1.

Referring to FIGS. 1 and 2, an insulation displacement connector (IDC) assembly comprises a first connector 1 having a first dielectric housing 10 fixed to a circuit board (not shown), and a second connector 2 including a second dielectric housing 20, a terminating cover 22 and a pressing member 23. A plurality of second terminals 21 is received in corresponding receiving passageways (not labeled) defined in the second housing 20. Each second terminal 21 comprises a piercing section 212 for terminating a flat flexible cable (not shown), and a connecting section 211 for engaging with a corresponding first terminal (not shown) received in the first housing 10 of the first connector 1. The terminating cover 22 is mounted to the second housing 20 for pressing the flat flexible cable to the piercing sections 212 of the corresponding second terminals 21. The pressing member 23 is attached to the terminating cover 22 for securely positioning the flexible cable to be appropriately bent and disposed between the terminating cover 22 and the pressing member 23.

The first housing 10 of the first connector 1 comprises a projecting portion 11 for engaging with the second housing 20 of the second connector 2, and a pair of latching portions 12 at opposite ends for engaging with the pressing member 23. The projecting portion 11 defines a plurality of channels 14 for receiving the first terminals therein. Each latching portion 12 is planar and vertically extends from the first housing 10, and forms a pair of hooks 13 on free ends thereof for engaging with the pressing member 23.

The second housing 20 of the second connector 2 is elongate and comprises an upper portion 205 and a lower portion 204. The lower portion 204 forms a cavity 206 for receiving the projecting portion 11 of the first housing 10. The receiving passageways are defined in the upper portion 205 in communication with the cavity 206. The second terminals 21 are received in the corresponding receiving passageways with the piercing sections 212 extending beyond the upper portion 206 for terminating the flexible cable and the connecting sections 211 downwardly extending into the cavity 206 of the lower portion 204 for connecting with the corresponding first terminals of the first connector 1. A pair of yokes 202 is integrally formed on opposite ends of the second housing 20. A receiving channel 201 is defined between each yoke 202 and the upper portion 204. A pair of barbs 203 extends from an inner surface of each yoke 202 into the corresponding receiving channel 201 for engaging with the terminating cover 22.

The terminating cover 22 comprises a main plate 221, and a pair of cantilevered arms 222 on opposite ends of the main plate 221. A plurality of elongate slots 227 is defined in the main plate 221 corresponding to the receiving passageways of the second housing 20 for receiving the piercing sections 212 of the corresponding second terminals 21 after the second terminals 21 have pierced through the flexible cable. A plurality of arcuate recesses 226 is defined in a bottom face of the main plate 221 for engaging and pressing corresponding wires (not shown) of the flexible cable. A latching hook 225 is formed on a free end of each cantilevered arm 222 for abutting against the inner surface of the corresponding yoke 202 of the second housing 20. A receiving slot 223 is defined between each cantilevered arm 222 and the main plate 221 for engaging with the pressing member 23. A projection 228 extends from the main plate 221 into the corresponding receiving slot 223 and forms a bottom abutting face 224.

The pressing member 23 is attached to the terminal cover 22 for retaining the flexible cable in position and for preventing the cable from becoming disengaged from the second terminals 21 caused by additional external stress exerted on the cable due to vibration or other forces. The pressing member 23 comprises a main body 231 and a pair of latching arms 234 perpendicularly extending from opposite ends of the main body 231 for securing the second connector 2 with the first connector 1. A curved connecting portion 235 is formed between each latching arm 234 and the main body 231 for providing the latching arm 234 with proper resiliency. Each latching arm 234 comprises a latching hook 236 for engaging with the first housing 10 and a pressing section 237 for facilitating manual operation thereof. The latching hook 236 and the pressing section 237 of the latching arm 234 are located on opposite sides of the curved connecting portion 235. When an external force is exerted on the pressing portion 237, the latching hook 236 of the latching arm 234 simultaneously pivots outward about the curved connecting portion 235 thereby releasing the second connector 2 from the first connector 1.

The curved connecting portion 235 is semi-circular or arcuate and comprises a curved body 240, a groove 238 recessed in the curved body 240 and a pair of bumps 239 extending from opposite inner side walls of the curved body 240 into the groove 238. The groove 238 provides the curved connecting portion 235 and the latching arm 234 with sufficient deformation space and proper resiliency. A pair of rod-like engaging portions 232 perpendicularly extends from opposite ends of the main body 231 proximate the curved portion 235 and opposite the corresponding latching arms 234 for engaging within the corresponding receiving slots 223 of the terminating cover 22. Each engaging portion 232 forms a protrusion 233 at a free end thereof for abutting against the abutting face 224 of the corresponding projection 228 of the terminating cover 22.

Figure 3:
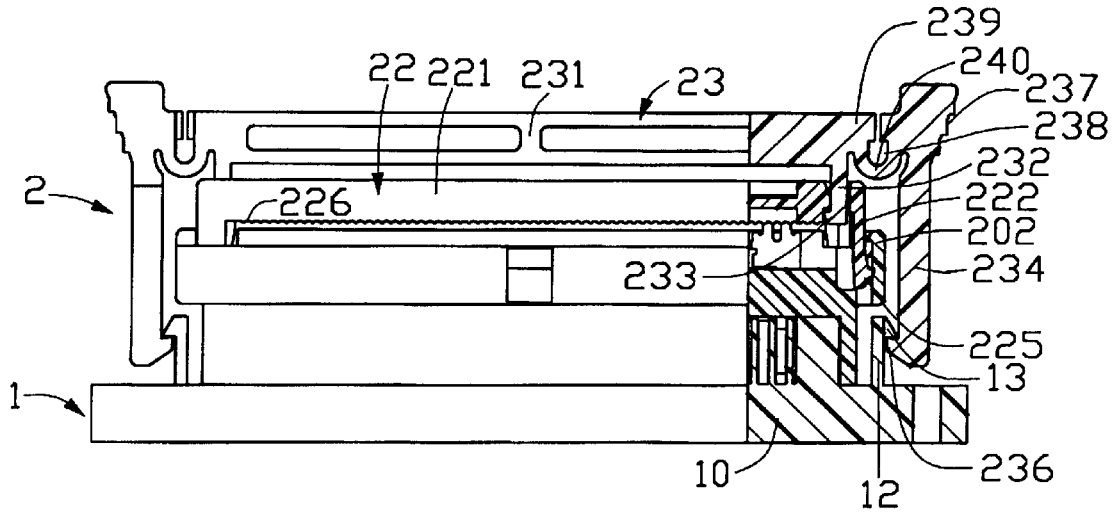
FIG. 3 is an assembled view of FIG. 2.
Figure 4:
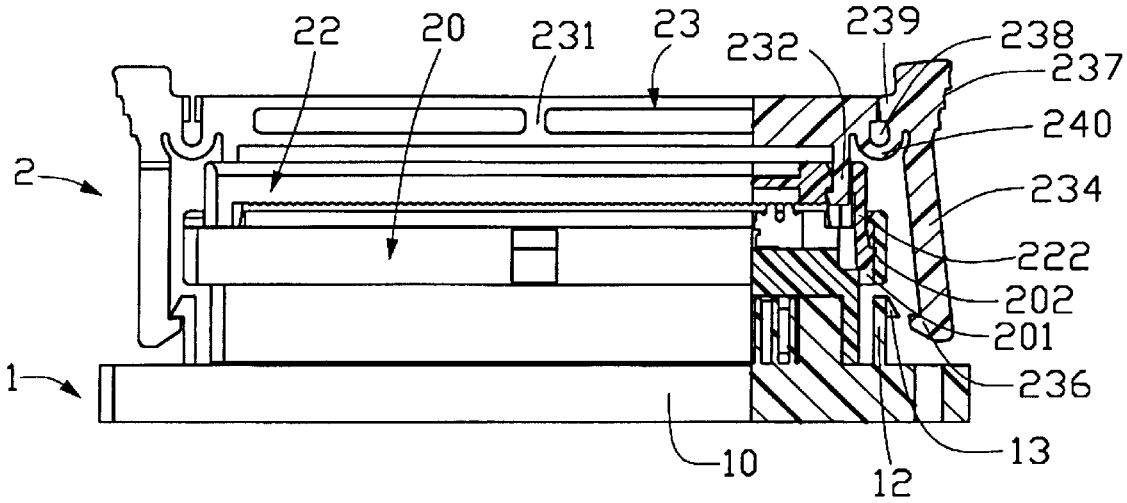
FIG. 4 is another assembled view of FIG. 2.

Referring also to FIGS. 3 and 4, in assembly, the projecting portion 11 of the first housing 10 of the first connector 1 is received in the cavity 206 of the second housing 20. The connecting sections 211 of the second terminals 21 are simultaneously inserted into the corresponding channels 14 of the first housing 10.

The terminating cover 22 is then fixed to the second housing 20. The cantilevered arms 222 are inserted into the corresponding receiving channels 201 of the upper portion 205 of the second housing 20. The barbs 203 of the second housing 20 engagingly abut against an outer surface of the corresponding cantilevered aims 222 of the terminating cover 22, while the latching hooks 225 of the terminating cover 22 engagingly abut against the inner surface of the corresponding yokes 202 of the second housing 20.

The pressing member 23 is subsequently assembled to the terminating cover 22. The engaging portions 232 are inserted into the corresponding receiving slots 223 of the terminating cover 22. The protrusions 233 of the engaging portions 232 engage with the abutting faces 224 of the corresponding projections 228 of the terminating cover 22. The latching arms 234 simultaneously engage with the corresponding latching portions 12 of the first housing 10 of the first connector 1. The latching hooks 236 of the latching arms 234 engage with the hooks 13 of the corresponding latching portions 12 of the first housing 10. Thus, the first connector 1 is securely connected with the second connector 2.

When the pressing section 237 of the latching arm 234 is pressed to inwardly pivot about the curved connecting portion 235, the bumps 239 are driven to approach and abut against each other, pivotal movement of the latching arm 234 simultaneously ceases and the latching hook 236 disengages from the first housing 10 of the first connector 1. Thus, the second connector 2 can be separated from the first connector 1 by disengaging the lower portion 204 of the second housing 20 from the projecting portion 11 of the first housing 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An insulation displacement connector (IDC) assembly for terminating a flat flexible cable, comprising:

a first connector comprising a first dielectric housing receiving a plurality of first terminals therein and forming a pair of latching portions on opposite ends thereof; and a second connector comprising a second dielectric housing, a plurality of second terminals received in the second dielectric housing, a terminating cover mounted to the second housing for facilitating termination between the flat flexible cable and the second terminals, and a pressing member attached to the terminating cover for securely positioning the flat flexible cable between the terminating cover and the pressing member, the pressing member comprising a main body and a latching arm downwardly extending from each end of the main body for engaging with corresponding latching portions of the first housing, a curved connecting portion being formed between the main body and each latching arm for providing the latching arm with proper resiliency relative to the main body and for allowing the latching arm to pivot thereabout, each latching arm comprising a pressing section at one end thereof for facilitating manual operation thereof, and a latching hook at the other end thereof for latching with corresponding latching portion of the first housing;

wherein each curved connecting portion of the pressing member resiliently deforms for ensuring corresponding latching arm to be smoothly driven to outwardly pivot about the curved connecting portion thereby releasing the second connector from the first connector when an external force is exerted on the pressing section of the latching arm;

wherein each curved portion of the pressing member comprises a curved body connecting the main body with the corresponding latching arm, a groove being defined in the curved body between the main body and the latching arm for providing the curved connecting portion with sufficient deformation space and proper resiliency for providing the latching arm with sufficient pivotal clearance;

wherein a pair of bumps respectively extends from inner surfaces of the latching arm and the main body into the groove for limiting a pivotal movement of the latching arms about the curved connecting portion;

wherein each latching portion of the second housing forms a pair of hooks for engaging with corresponding latching hooks of the pressing member;

wherein a pair of engaging portions perpendicularly extends from opposite ends of the main body of the pressing member for engaging with the terminating cover;

wherein each engaging portion of the pressing member further comprises a protrusion at a free end for engaging with the terminating cover;

wherein the second housing comprises an upper portion defining a plurality of receiving passageways for receiving the second terminals therein, and a lower portion forming a cavity for engaging with the first housing;

wherein the first housing comprises a projecting portion for receiving the first terminals therein and for being received within the cavity of the second housing;

wherein a pair of yokes is integrally formed with the upper portion of the second housing;

wherein a pair of receiving channels is defined in opposite ends of the second housing proximate corresponding yokes for engaging with the terminating cover;

wherein a pair of cantilevered arms perpendicularly extends from opposite ends of the terminating cover for being inserted into corresponding receiving channels of the second housing, and each cantilevered arm forms a latching hook on a free end thereof for engagingly abutting against an inner surface of the corresponding yoke;

wherein a pair of receiving slots is defined in opposite ends of the terminating cover for engaging with the pressing member;

wherein a pair of rod-like engaging portions perpendicularly extends from opposite ends of the pressing member proximate the curved connecting portion for being engagingly inserted into corresponding receiving slots of the terminating cover;

wherein the terminating cover comprises a main plate defining a plurality of arcuate recesses in a bottom surface thereof for engaging with corresponding wires of the flat flexible cable.

* * * * *